United States Patent [19]

Verlinden et al.

[11] 3,940,116

[45] Feb. 24, 1976

[54] ICE DISPENSER

[75] Inventors: Jerry M. Verlinden; Gary D. Swinford, both of Denver; Kyle L. DeJaeger, Broomfield; Michael W. Kennedy, Englewood, all of Colo.

[73] Assignee: Mile High Equipment Company, Denver, Colo.

[22] Filed: Apr. 24, 1974

[21] Appl. No.: 463,615

[52] U.S. Cl. ..... 259/45; 259/41; 222/228; 416/240

[51] Int. Cl.[2] ..... B01F 7/04

[58] Field of Search ..... 259/9, 10, 41, 45, 46, 259/DIG. 32; 222/228; 416/240

[56] References Cited

UNITED STATES PATENTS

| | | | |
|---|---|---|---|
| 2,991,051 | 7/1961 | Jones | 416/240 X |
| 3,145,017 | 8/1964 | Thomas | 259/45 |
| 3,366,368 | 1/1968 | Hibbing | 259/45 |
| 3,809,295 | 5/1974 | Vitencz | 259/45 X |

*Primary Examiner*—Stanley N. Gilreath
*Assistant Examiner*—Alan Cantor
*Attorney, Agent, or Firm*—Coffee and Sweeney

[57] ABSTRACT

An ice storage and dispensing device for flaked or other particulate ice which maintains the ice in an agitated dispensable condition or state. The device includes a hopper equipped with an agitator having a rotatable shaft and axially and angularly spaced rigid agitator spokes extending generally radially from the shaft. The ends of flexible polyvinylchloride tube members are received over and secured to certain of the axially and radially spaced spokes to provide generally helically extending lengths of the tubes between the spokes. The flexible tubes wipe against the inside wall of the hopper with a squeegee effect to prevent ice buildup. The tubes also lessen the tendency of the spokes to create tunnels in the particulate ice, especially at the ice setting temperature.

10 Claims, 6 Drawing Figures

ICE DISPENSER

BACKGROUND OF THE INVENTION

1. Field of the Invention

This invention relates to ice dispensing machines of the type which maintain particulate ice under agitation and more particularly relates to an agitator system for lessening tunneling and congealing of the ice.

2 Brief Description of the Prior Art

Devices for feeding or dispensing pulverized, chipped or flaked ice are useful for various refrigerating or cooling purposes. For example, dairy products, such as milk and cream in containers, are often packed in large crates and it is desirable to deposit an amount of chipped or flaked ice in the crates, e.g., as the crates are moved along a conveyor, to insure proper refrigeration of the crate contents. Flaked ice also is used extensively in mixed drinks such as fruit flavored drinks in slush-type form. For this purpose an ice dispenser is used. One type of dispenser includes a hopper for holding the ice, a delivery system such as a screw feed for delivering ice from the hopper, and an agitator for maintaining the ice in the hopper in a particulate agitated state for proper delivery from the dispenser. The agitator has a rotatable shaft with a plurality of agitating blades or other means carried thereon to agitate the ice. In one device generally radially extending rigid spokes are provided which churn through the ice as the agitator shaft rotates. However, it has been found that the use of such agitators can lead to ice buildup or congealing at the hopper walls and the spokes can create undesirable tunneling in the particulate ice especially at the temperature of setting.

SUMMARY OF THE INVENTION

The present invention provides an improvement in ice storage and dispensing devices of the character described in which generally radially extending rigid agitator members or spokes are used to churn through the ice. In accordance with the present invention, flexible agitator means are secured to and extend between the ends of certain axially spaced spokes. The flexible means comprises tubular members positioned so as to ride close to and wipe against the hopper wall to prevent congealing as well as prevent tunneling of the spokes through the ice within the hopper.

While this invention is susceptible of embodiment in many different forms, there is shown in the drawings and will herein be described in detail specific embodiments therefor, with the understanding that the present disclosure is to be considered as an exemplification of the principles of the invention and is not intended to limit the invention to the embodiment illustrated.

DESCRIPTION OF THE PREFERRED EMBODIMENT

Figure 1:
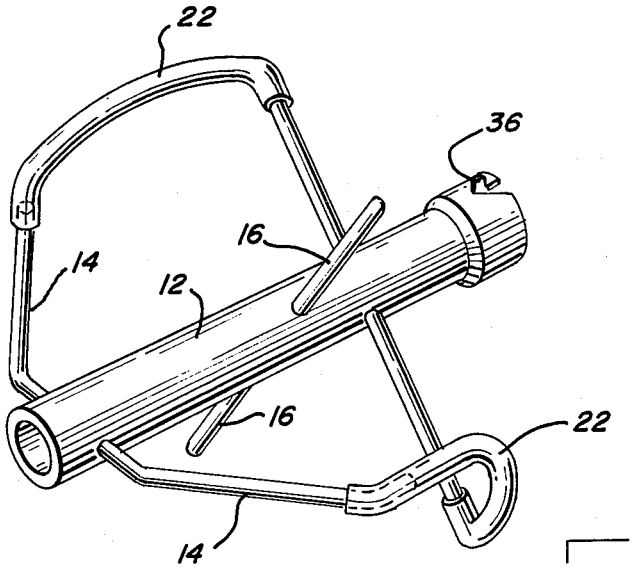
FIG. 1 is a perspective view of one form of the agitator assembly of the present invention.

Referring first to the form of the invention shown in FIG. 1, the agitator assembly used in the storage and dispenser device of the present invention includes a tubular shaft 12 having a plurality (three pair shown) of rigid agitator bars or spokes 14, 16 and 18 extending laterally or generally radially therefrom. Each pair may comprise a single rod extending diametrically through the shaft 12. Two lengths of F.D.A. approved polyvinylchloride plastic tubes 20 and 22 are provided with their open ends received on the ends of spokes 14 and 18 so that they extend both lengthwise and angularly of the shaft 12 forming generally helically shaped flexible wipers. In other words, the ends of spokes 14 and 18 being axially and radially spaced from each other causes the tubes 20 and 22 to assume their generally helical shape.

Figure 2:
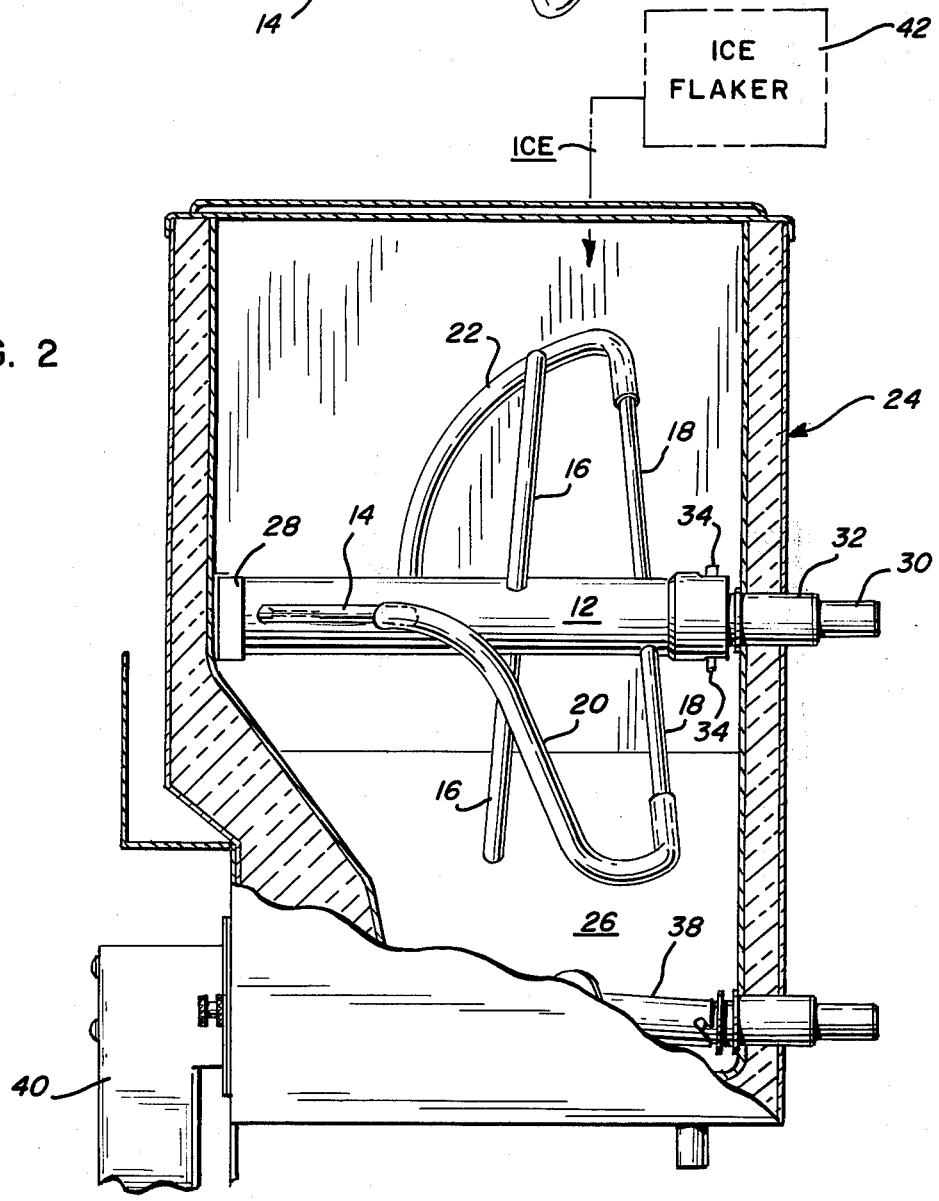
FIG. 2 is a vertical section through a form of ice dispensing device provided by the present invention and using the agitator of FIG. 1.
Figure 4:
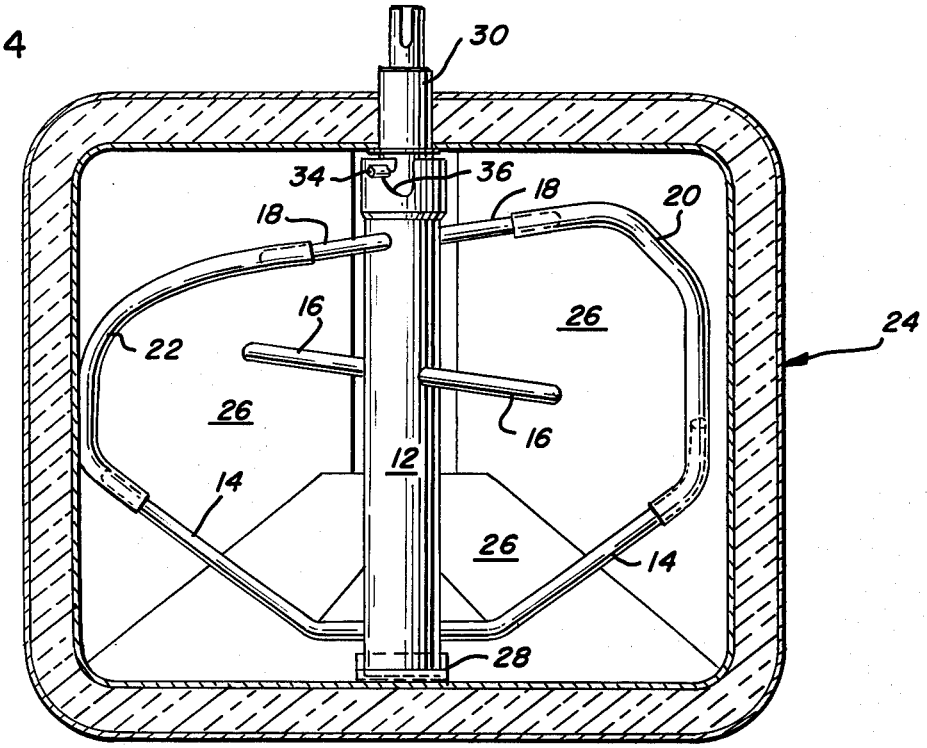
FIG. 4 is a horizontal section through the device taken generally along the line 4—4 in FIG. 3.
Figure 3:
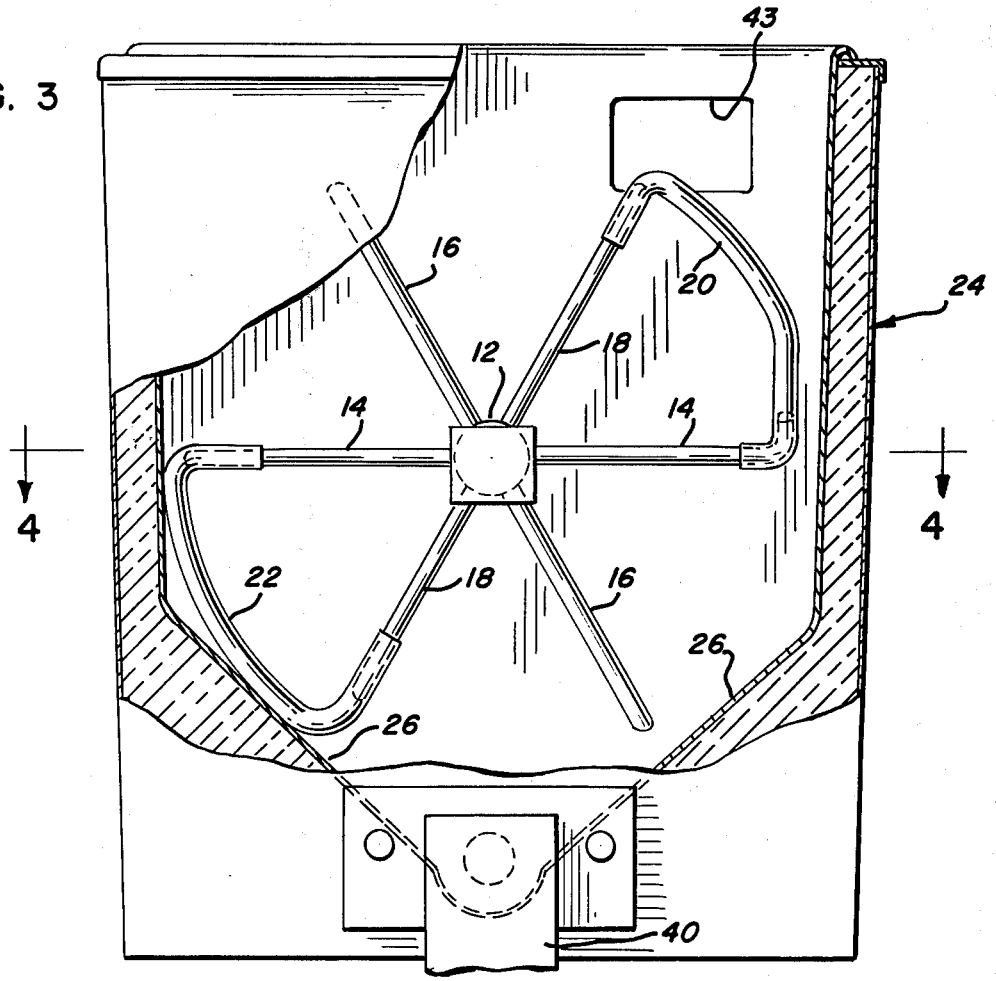
FIG. 3 is a partial vertical sectional view showing the agitator within the dispensing device as viewed from the left in FIG. 2.

Referring now to FIG. 2, the agitator assembly is mounted for rotation in the storage bin portion of an ice dispenser, generally designated 24, which has insulated sloping sidewalls 26 defining an ice hopper. More particularly, one end of shaft 12 is journalled for rotation in a U-bracket 28 (FIGS. 2 through 4) which in turn is secured to an inside wall 29 of hopper 26. The other end of shaft 12 is received on a drive shaft 30 extending through a bearing block 32 (FIGS. 2 and 4) to the outside of the dispenser 24 where it may be driven by suitable motor means (not shown). Pins 34 (FIGS. 2 and 4) on shaft 30 are received in slots 36 (FIGS. 1 and 4) at the end of shaft 12 providing a driving connection between shafts 30 and 12. As the agitator assembly rotates, the flexible tubes 20 and 22 wipe the sloped sidewalls of the storage bin or hopper, as shown in FIGS. 3 and 4, and prevent congealing of the ice. The tubes 20 and 22 also prevent channeling or tunneling through the ice in hopper 26 which may otherwise be caused by the spokes 14, 16 and 18.

At the bottom of hopper 26 there is provided an auger 38 (FIG. 2) driven by suitable motor means (not shown) for delivering particulate ice from the storage bin or hopper through an ice dispensing chute 40.

In use, the ice dispenser 24 receives ice from an ice flaker, as at 42 (FIG. 2) through an entry opening 43 (FIG. 3) and rotation of the agitator assembly maintains the ice in an agitated deliverable state. The auger 38 can be driven from time to time whenever it is desired to dispense ice through chute 40.

Figure 5:
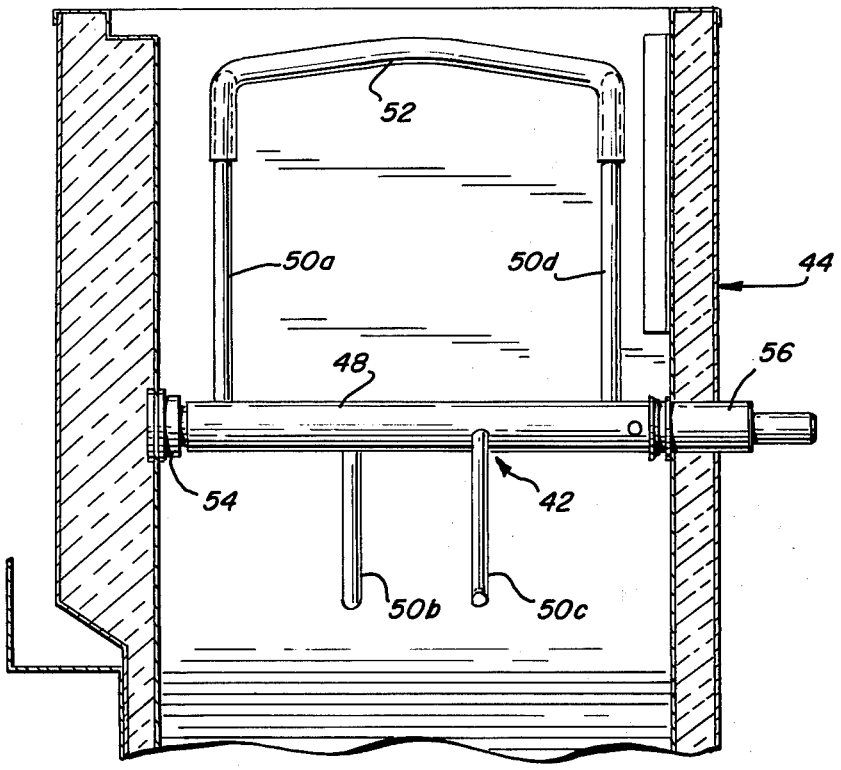
FIG. 5 is a vertical section similar to that of FIG. 2, of a modified form of the invention.
Figure 6:
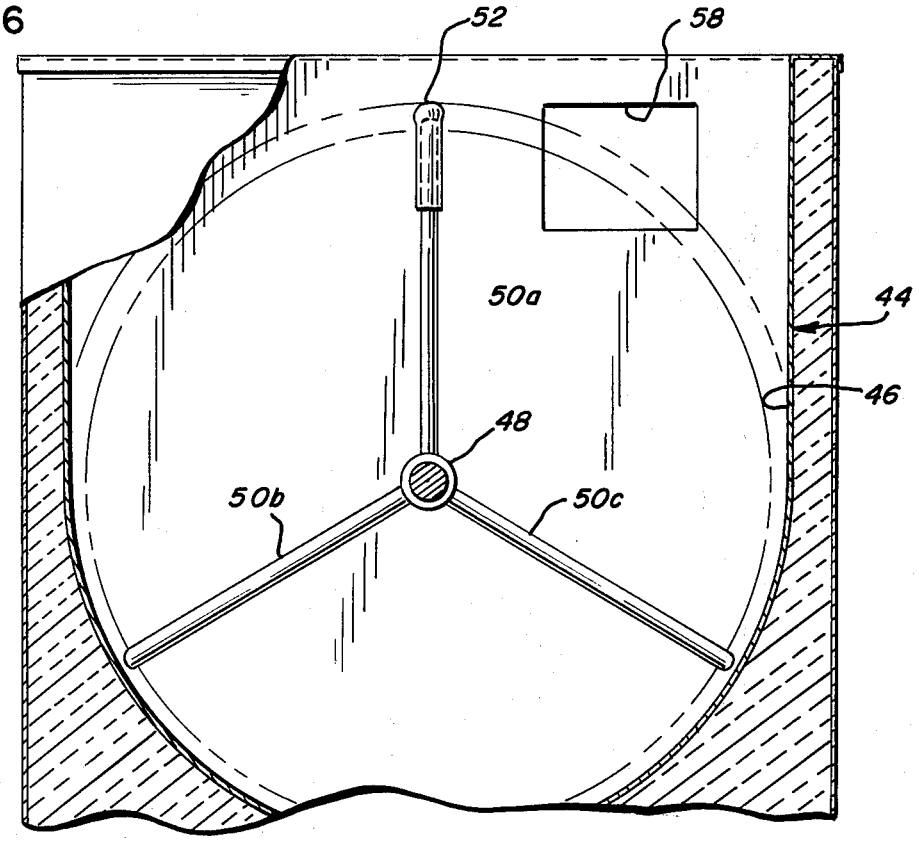
FIG. 6 is a partial vertical sectional view similar to that of FIG. 3, of the form of the invention shown in FIG. 5.

The embodiment shown in FIGS. 5 and 6 incorporates the general principles set forth above except that the shape of the storage bin, and the disposition of the agitator spokes and tubing is somewhat different. More particularly, an agitator assembly, generally designated 42, is mounted within a storage bin, generally designated 44, which is provided with a circular interior wall 46, as seen in FIG. 6, rather than the trough-like or V-shaped storage bin shown in FIGS. 1–4.

The agitator assembly 42 includes a tubular shaft 48 having a plurality (four shown) rigid agitator bars or spokes **50*a* through 50*d* spaced lengthwise along the shaft 48. As best seen in FIG. 6, the spokes 50*a* and 50*d* generally are in a common plane passing through the shaft 48. The spokes 50*b* and 50*c* are disposed angularly about the shaft 48 generally equidistant from the spokes 50***a*, 50*d*. A length of F.D.A. approved polyvinylchloride plastic tubing 52 is provided with its open ends received on the ends of the coplanar spokes 50*a*, 50*d* so that as the agitator assembly rotates, the flexible tubing 52 wipes the circular sidewalls of the storage bin as seen in FIG. 6. The spokes 50*b* and 50*c*, being disposed axially within the coplanar spokes 50*a*, 50*d* facilitate the agitating function as the tubing 52 prevents congealing of the ice and also prevents channeling or tunneling through the ice in the hopper which otherwise may be caused by simple spokes.

The shaft 48 is journalled for rotation in the storage bin by means of a bracket 54 at one end and a bearing block 56 at the other.

As with the embodiment shown in FIGS. 1–4, the bottom of the hopper or storage bin 46 is provided with an appropriate auger driven by suitable motor means for delivering particulate ice from the storage bin or hopper through an appropriate ice dispensing chute.

Again, in use, the ice dispenser receives ice from an ice flaker through an entry opening 58 (FIG. 6).

I claim:

1. In an ice storage or dispensing device for storing particulate ice in an agitated state or condition, including an ice storage hopper having interior wall means and an agitator assembly within the hopper for agitating the ice, said agitator assembly having spoke-like agitator members for churning through the particulate ice, the improvement which comprises agitator means secured to and extending between said spokes for wiping said interior wall means of the storage hopper, said agitator means being fabricated of pliable material so as to be bodily deformable by said particulate ice thereby minimizing tunneling in the particulate ice.

2. In an ice storage device for storing particulate ice in an agitated state or condition, including an ice storage hopper having interior wall means and an agitator assembly within the hopper for agitating the ice, said agitator assembly having spoke-like agitator members for churning through the particulate ice, the improvement which comprises an agitator means in the form of an open ended length of plastic tubing secured to and extending between the free ends of a pair of said spokes with the free ends received in the open ends of the tubing for wiping said interior wall means of the storage hopper and minimizing tunneling in the particulate ice.

3. The device of claim 2 wherein said spokes are mounted on a rotatable shaft having a generally horizontal axis and the tubing extends in a generally horizontal direction.

4. The device of claim 3 wherein said tubing is polyvinylchloride tubing.

5. The device of claim 3 wherein the lower wall portion of said hopper slopes inwardly to define a generally V-shaped lower sidewall cross section in contact with and wiped by said tubing during rotation of said shaft, and including an auger adjacent the bottom of said lower wall mounted for rotation on an axis generally parallel to the agitator shaft axis, and outlet means for receiving ice driven by the rotating auger.

6. The device of claim 2 wherein a pair of said spokes are spaced axially and angularly along an agitator shaft and said tubing extends in a generally helical direction.

7. The device of claim 2 wherein a pair of said spokes are spaced axially along the agitator shaft in a generally common plane and said tubing extends generally axially of the agitator shaft.

8. The device of claim 7 including at least one free ended spoke on the agitator shaft spaced angularly of said pair of spokes.

9. The device of claim 8 wherein said one spoke is disposed between the pair of spokes having said tubing thereon.

10. A device for storing ice in an agitated state, comprising: a hopper having sidewalls sloping inwardly toward the hopper bottom to define a trough at the bottom of the hopper, means in said trough for delivering particulate ice from said hopper, agitator means mounted above said delivery means on a generally horizontal axis generally parallel to the trough bottom including a rotatable shaft having generally radially extending axially and angularly spaced rigid spoke members which normally create tunnels in ice in the hopper during rotation of said shaft especially when the ice is at setting temperature, and a flexible polyvinylchloride tube having open ends receiving ends of two spoke members, said tubing extending in a generally helical path in close proximity to and against the hopper bottom wall for wiping said wall as the shaft is rotated.

* * * * *